US005445547A

United States Patent [19]

Furukawa

[11] Patent Number: 5,445,547

[45] Date of Patent: Aug. 29, 1995

[54] OUTBOARD MOTOR

[75] Inventor: Akiyoshi Furukawa, Wako, Japan

[73] Assignee: Honda Giken Kogyo Kabushiki Kaisha, Tokyo, Japan

[21] Appl. No.: 261,243

[22] Filed: Jun. 14, 1994

Related U.S. Application Data

[63] Continuation of Ser. No. 887,027, May 22, 1992, abandoned.

[51] Int. Cl.[6] ..... B63H 21/26

[52] U.S. Cl. ..... 440/77; 440/88

[58] Field of Search ..... 440/77, 88, 89; 123/41.65, 41.66

[56] References Cited

U.S. PATENT DOCUMENTS

| | | | |
|---|---|---|---|
| 1,331,649 | 2/1920 | Kettering | 123/41.66 |
| 2,699,764 | 1/1955 | Kiekhaefer | 416/247 |
| 4,692,123 | 9/1987 | Tada et al. | 440/77 |
| 4,722,709 | 2/1988 | Irwin et al. | 440/89 |
| 4,734,076 | 3/1988 | Mondek | 440/77 |
| 4,887,692 | 12/1989 | Outani et al. | 440/89 |
| 4,963,110 | 10/1990 | Otani et al. | 440/77 |
| 4,978,321 | 12/1990 | Ferguson | 440/88 |

FOREIGN PATENT DOCUMENTS

| | | | |
|---|---|---|---|
| 41291 | 3/1982 | Japan | 440/77 |
| 194695 | 11/1983 | Japan | 440/88 |
| 100093 | 6/1984 | Japan | 440/88 |
| 8312 | 1/1989 | Japan | 123/41.65 |

*Primary Examiner*—Michael S. Huppert
*Assistant Examiner*—Thomas J. Brahan
*Attorney, Agent, or Firm*—Armstrong, Westerman, Hattori, McLeland & Naughton

[57] ABSTRACT

An outboard motor having an engine compartment covered by an engine cover at its top portion and having an engine disposed within the engine compartment with its crankshaft directed in the vertical direction, in which charging efficiency of the engine is improved with a simple structure and a shielding property of the entire surrounding of the engine is also enhanced. A suction chamber communicating with an intake section of the engine is disposed on a surface other than the top surface of the engine and on one side of the inside of the engine compartment, an air intake port is provided in the engine cover at a position close to the other side of the inside of the engine compartment, an air exhaust port is provided in the engine cover, and a duct is provided within the engine compartment for leading air from the air intake port towards the suction chamber while making a detour to avoid a route above the engine.

6 Claims, 7 Drawing Sheets

OUTBOARD MOTOR

This application is a continuation of application Ser. No. 07/887,027, filed May 22, 1992, now abandoned.

BACKGROUND OF THE INVENTION

1. Field of the Invention

The present invention relates an outboard motor which can be detachably mounted to a stern for propelling a boat.

2. Description of the Related Art

The above-mentioned type of outboard motor includes a casing consisting of a main body case to be mounted to a hull via a bracket and an engine cover which can be detachably mounted to an upper surface of the main body case, and an engine is disposed within an engine compartment delimited by the above-mentioned main body case and the engine cover. The main body case is composed of an under case forming a part of the engine compartment, an extension case hanging from the above-mentioned under case and having a transverse cross-section contour nearly having an airfoil shape, and a gear case provided at the lower end portion of the above-mentioned extension case, a drive shaft connected to an output shaft of the engine penetrates vertically through the extension case and is connected within the gear case to a propeller shaft directed to the front and rear directions, and a propeller is provided on the above-described propeller shaft.

Accordingly, as an engine for use in an outboard motor, a vertical type engine in which a crank shaft is disposed vertically, is employed, and in the case of a multi-cylinder engine, it is a common practice to direct the center axes of the respective cylinders horizontally in the back and forth directions and to dispose these cylinders as arrayed in the vertical direction.

Engine intake air is introduced into an engine compartment through an air intake port provided in the engine cover, and sucked into cylinders through an intake section of the engine (intake pipe, carburetor, etc.), but this intake air is heated by heat of the engine within the engine compartment and is liable to rise in temperature, and if an intake air temperature should rise in this way, a charging efficiency world be lowered.

Hence, an outboard motor in which an engine compartment is partitioned by a partition wall into an engine side and an outside of the partition wall to make cooling air flow though the engine side and to make the intake air of the engine to be sucked into the engine through the outside the partition wall, has been known as disclosed in Laid-Open Japanese Utility Model Specification No. 60-95293 (1985). In this outboard motor, an engine cover is composed of a fan cover which covers a cooling fan, an engine main body and a carburetor from the above with a ventilation gap retained therebetween and has its bottom surface opened, a bottom cover extending outwards nearly horizontally from the bottom of the fan cover and then rising, and a top cover which covers the above-mentioned fan cover from the above with a ventilation gap retained therebetween and has its bottom end connected to the top end of the above-mentioned bottom cover. An air intake port is drilled in the upper wall of the above-mentioned top cover. A suction port of the above-described cooling fan is drilled in the upper wall of the above-mentioned fan cover. A suction chamber is disposed between opposed side walls of the aforementioned fan cover and bottom cover. An inlet of this suction chamber is separated from the above-mentioned air intake port and is opened in the opposite direction to the aforementioned air intake port. And an outlet of the suction chamber is connected to the above-described carburettor via through-holes provided in the above-mentioned fan cover.

In the above-described outboard motor in the prior art, since an engine cover must be composed of a fan cover, a bottom cover and a top cover in order to separate air intaken to the inside of the engine cover into intake air and cooling air, a structure of an engine cover becomes complex. In addition, for the purpose of preventing hot air surrounding an engine from rising and stagnating on the bottom surface side of the fan cover, cooling air is exhausted to the below, and the construction of opening the fan cover downwards for that purpose has made it difficult to shield the entire surrounding of the engine.

SUMMARY OF THE INVENTION

It is therefor an object of the present invention to provide an outboard motor in which charging efficiency of an engine is enhanced with a simple structure and a shielding property of an entire surrounding of an engine is improved.

According to one feature of the present invention, there is provided an outboard motor including an engine compartment formed at its top portion and covered by an engine cover, and an engine disposed within the engine compartment with its crankshaft directed in the vertical direction; which comprises a suction chamber communicating with an intake section of the engine and disposed on a surface other than a top surface of the engine and on one side within the engine compartment, an air intake port provider in the engine cover at a position close to the other side within the engine compartment, an air exhaust port provided in the engine cover, and a duct provided within the engine compartment for leading air from the air intake port towards the suction chamber while making a detour to avoid a route above the engine.

According to the present invention, while air introduced though an air intake port is led to a suction chamber though a duct, this duct makes a detour to avoid a route above the engine where air heated by the engine rises and a high temperature is built up. Accordingly, low-temperature air introduced though the air intake port is in itself sucked into the suction chamber, and since this air is sucked into the engine though an intake section, charging efficiency is improved.

As an engine cover is necessitated only to be provided with an air intake port and an air exhaust port, its structure is simple, and also since an engine compartment is perfectly covered by this engine cover, there is no fear that sea water or the like may invade the engine compartment.

According to another feature of the present invention, there is provided an outboard motor including an engine compartment formed at its top portion and covered by an engine cover, and an engine disposed within the engine compartment with the crankshaft shaft directed in the vertical direction; wherein a suction chamber communicating with an intake section of the engine is disposed in a side portion of the engine, a suction opening communicating with the inside of the engine compartment at a lower portion of the engine compartment is provided in the suction chamber, a duct communicating with an air intake port provided in the above-mentioned engine cover is provided within the above-mentioned engine compartment, an outlet opening of the aforementioned duct is opposed from the below to the above-mentioned section opening, and an air exhaust port is provided at an upper portion of the above-mentioned engine cover.

According to the present invention, air introduced through the air intake port is led through the duct to its outlet opening without being influenced by engine heat, and it is directly sucked from the above-mentioned outlet opening to the suction opening of the suction chamber opposed to the outlet opening. Since the above-described outlet opening and suction opening are provided at the lower portion of the inside of the engine compartment, and also since air heated by the engine within the engine compartment world rise and would be exhausted to the outside though the air exhaust port at the upper portion, when the introduced air is sucked from the above-mentioned outlet opening to the above-mentioned suction opening, air heated by the engine would not mix to the introduced air. Furthermore, according to still another feature of the present invention, there is provided an outboard motor, including an engine compartment formed at its top portion and covered by an engine cover, an engine disposed within the engine compartment with its crankshaft directed in the vertical direction, and a flywheel mounted to an end portion of the crank shaft projecting upwards from an engine body; which comprises an air exhaust port provided at a top portion of the engine cover, fan blades provided on the upper surface of the flywheel for directing air within the engine compartment to the air exhaust port, and an air communication port provided in the flywheel for communicating air from the below of the flywheel towards the fan blades.

According to the present invention, within the engine compartment is produced an air flow flowing from a lower portion towards an upper portion by the blades, and the respective portions of the engine can be effectively cooled by this air flow. Especially, hot air normally stagnating at the portion right under the flywheel is extracted by the fan blades through the air communication port provided on the flywheel. Therefore, deterioration of durability of parts disposed at the portion right under the flywheel such as, for instance, as timing belt, an exciter coil, a change coil, etc. caused by heat, can be effectively prevented.

The above-mentioned and other objects, features and advantages of the present invention will become more apparent by reference to the following description of preferred embodiments of the invention taken in conjunction with the accompanying drawings.

BRIEF DESCRIPTION OF THE DRAWINGS

In the accompanying drawings:

FIG. 5 is a top view of an engine cover;

FIG. 6 is a cross-section view taken along line VI—VI in FIG. 5;

FIG. 7 is a top view of an under case;

FIG. 8 is a cross-section view taken along line VIII—VIII in FIG. 7;

FIG. 9 is a top view showing a relative arrangement of a flywheel cover and a suction chamber within an engine compartment;

DESCRIPTION OF THE PREFERRED EMBODIMENTS

Figure 1:
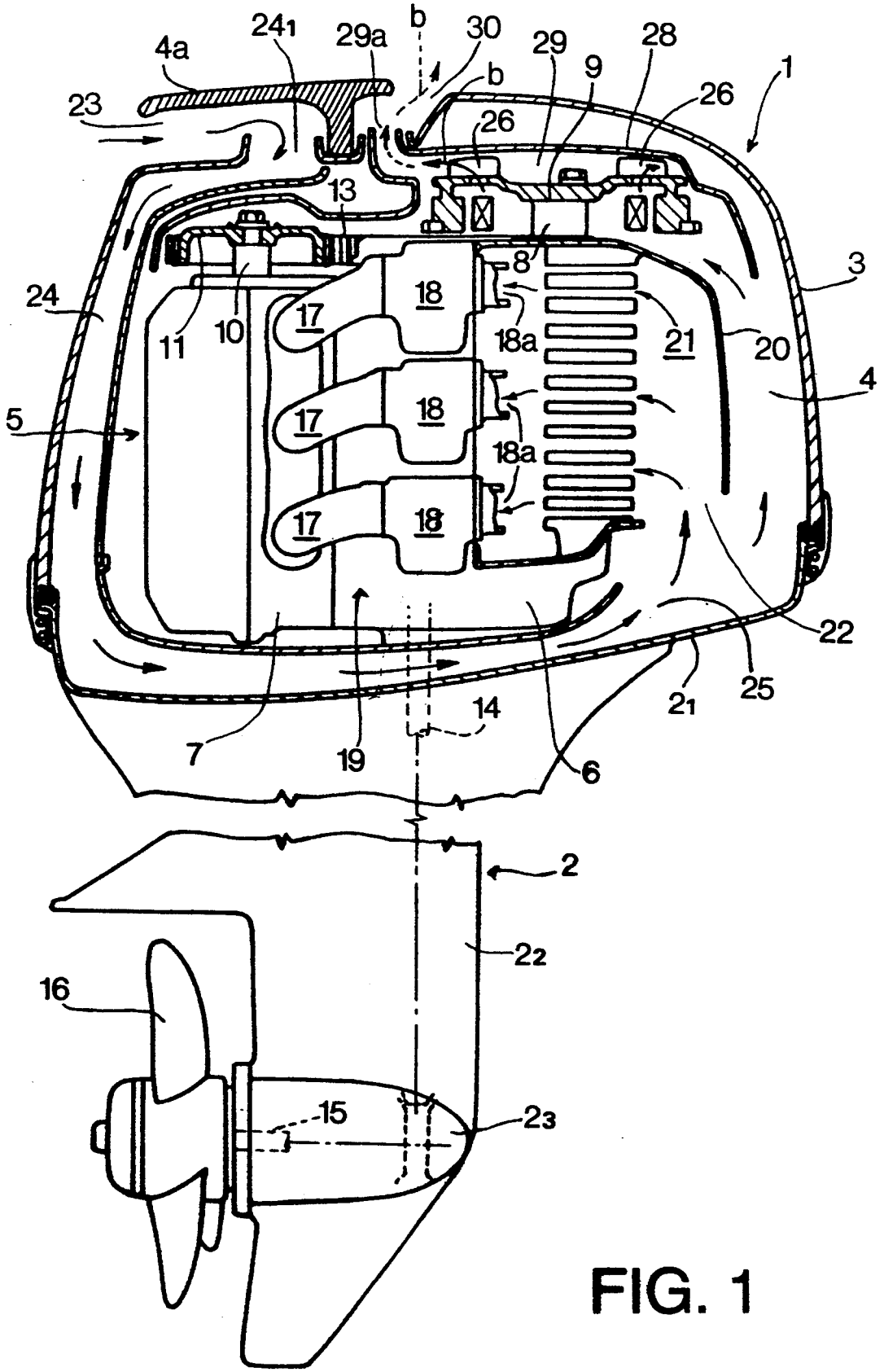
FIG. 1 is a side view partly in cross-section showing an outboard motor according to one preferred embodiment of the present invention as severed into two parts.

Now one preferred embodiment of the present invention will be described with reference to FIG. 1, in which an outboard motor 1 is illustrated as a side view partly in cross-section as severed into two parts. This outboard motor is mounted to a stern of a boat with its right side as viewed in the figure directed to the hull side.

Reference numeral 2 designates a main body case extending downwards, which consists of an under case 21, an extension case $2_2$ and a gear case $2_3$, and this main body case 2 is mounted to a stern via a fitting bracket. An upper opening of the under case 21 is covered by an engine cover 3, an engine compartment 4 is formed at a top end portion of the outboard motor 1 by the engine cover 3 and under case 21, and an engine 5 is provided within this engine compartment 4. This engine 5 is a water-cooled engine, in which provision is made such that after cooling sea water sucked up by a water pump, not shown, has circulated through the engine, it is returned again into the sea.

In the illustrated embodiment, the engine 5 is a three-cylinder engine, which is accommodated within the engine compartment 4 with a crankcase 6 disposed in the front portion and a cylinder head 7 disposed in the rear portion, the three cylinders extend horizontally and, respectively, in the front and rear directions and are arrayed in one row along the vertical directions with respect to one another, and accordingly, a crankshaft 8 is directed in the vertical direction. The crankshaft 8 penetrates through the crank case 6 and projects upwards, and a flywheel 9 is mounted to the top end portion of the crank shaft 8. On the other hand, a camshaft 10 projects upwards from the cylinder head 7, and a timing belt 13 is stretched between a toothed pulley 11 mounted to the camshaft 10 and a toothed pulley 12 (See FIG. 2) provided on the crankshaft 8.

The crankshaft 8 is also coupled to a drive shaft 14 either directly or via an appropriate transmission mechanism and drives this drive shaft 14. The drive shaft 14 extends out of the engine 5, and extends downwards through the inside of the extension case $2_2$. To the bottom end of the drive shaft 14 is drivably connected a propeller shaft 15 extending backwards, and a propeller 16 is mounted to a backwardly projecting rear end portion of this propellers shaft 15.

Intake pipes 17 and carburetors 18 for the respective cylinders are arrayed vertically in a side portion of the engine 5, that is, on the nearest side as viewed in FIG. 1, and an intake section 19 of the engine 5 is composed of these members. Inlets 18*a* of the respective carburetors 18 communicate with a single suction chamber 21 surrounded by an enclosure wall 20. At the bottom of the enclosure wall 20 is provided a suction opening 22, and the suction chamber 21 communicates with a lower portion of the inside of the engine compartment 4 through this suction opening 22.

At a rear end portion of an upper wall of the engine cover 3, that is, at an end portion on the opposite side to the hull is provided an air intake port 23 opening towards the rear. It is to be noted that a sheet thickness of a cover portion 4*a* forming a top portion of this air intake port 23 is made thick to form a handle for gripping at the time of drawing up or tilting the outboard motor 1. Instead of this, the cover portion 4*a* may be made constructively rigid by, for instance, using a rigid material other than that of the engine cover 3 or provided with ribs or the like. The air intake port 23 communicates with a duct 24 provided within the engine compartment 4 through its inlet opening $24_1$. The duct 24 extends downwards along an inner surface of the engine cover 3 at the rear of the engine 5, and thereafter it extends forwards under the engine 5 along the bottom of the engine compartment 4, and communicates with the inside of the engine compartment 4 through an outlet opening 25 at its front end. And, this outlet opening 25 is positioned right under the intake opening 22 of the above-mentioned suction chamber 21 and is opposed to the above-described intake opening 22.

Figure 2:
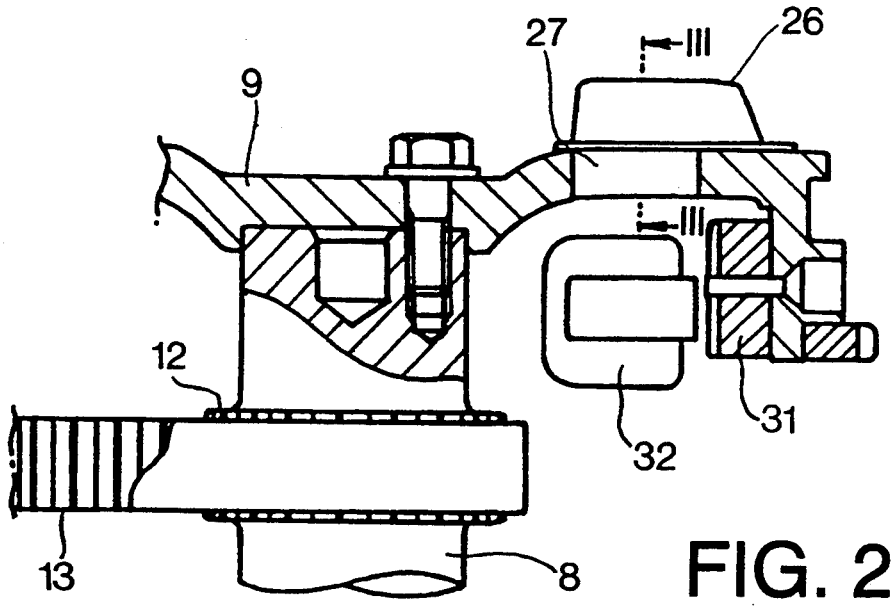
FIG. 2 is a partial cross-section view showing the portion of a flywheel.
Figure 3:
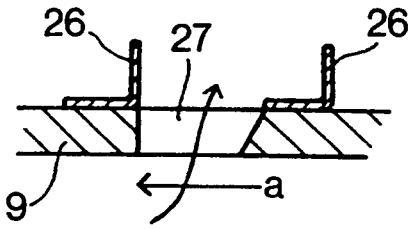
FIG. 3 is a cross-section view taken along line III—III in FIG. 2.
Figure 4:
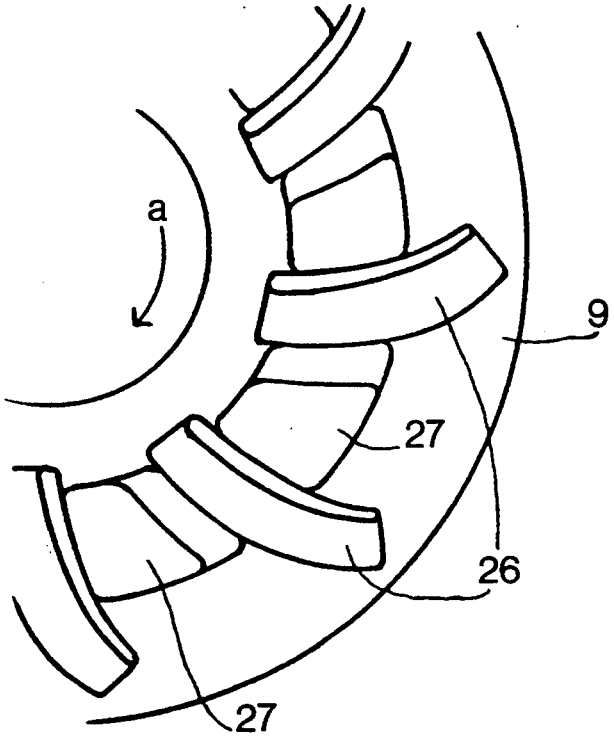
FIG. 4 is a partial top view of a flywheel.

FIGS. 2 to 4 are schematic views showing a part of the above-described flywheel 9. As seen from these figures and FIG. 1, a large number of fan blades 26 are arrayed in an annular form on the upper surface of the flywheel 9, and in the flywheel are drilled air communication ports 27 for communicating air through the spaces between the fan blades 26 from below. These air communication ports 27 are formed in such shape that they can easily load the air under the flywheel 9 to the fan blades 26 when the flywheel 9 rotates in the direction of arrow as shown in FIGS. 3 and 4.

Furthermore, a flywheel cover 28 covering the top of the flywheel 9 forms a swirl chamber 29 which constitutes a fan in cooperation with the fan blades 26, and an outlet 29*a* of this swirl chamber 29 is faced to an air exhaust port 30 provided in the upper wall of the engine cover 3. Accordingly, upon operation of the engine 5, when the flywheel 9 rotates, air in the lower portion is sucked through the air communication ports 27 by the fan composed of the fan blades 26 and the swirl chamber 29, and it is exhausted to the outside through the air exhaust port 30 as shown by arrow b in FIG. 1.

The flywheel 9 serves also as a rotor of a dynamo, to that end the flywheel 9 has a bowl-shape opening downwardly, and dynamo parts such as magnets 31, coils 32 and the like are disposed within the bowl-shaped portion.

Since the illustrated embodiment is constructed in the above-described manner, atmospheric air flowing through the air intake port 23 into the engine compartment 4 due to a negative pressure generated within the engine compartment 4 by suction of the engine 5, is guided to the duct 24 and reaches the outlet opening 25 in front of the bottom of the engine compartment 4 without being heated by contact with the engine 5, and it flows from here into the engine compartment 4. Since the suction opening of the suction chamber 21 opens above the outlet opening 25 close to and as opposed to the outlet opening 25, and air coming out of the outlet opening 25 is in itself sucked into the suction chamber 21 directly through the suction opening 22. On the other hand, air heated by the engine 5 rises in the engine compartment 4 due to natural convection and forced ventilation by the fan blades and is exhausted to the outside through the air exhaust port 30 at the above, and therefore, the heated air never comes around to the proximity of the suction opening 22 from below. Accordingly, a charging efficiency of the engine 5 is improved, because only the air at a sufficiently low temperature just introduced through the air intake port 23 is sucked into the suction chamber 21.

Since only the air intake port 23 and the air exhaust port 30 are provided at the upper portion of the engine cover 3, the structure of the engine cover 3 is extremely simple, and also since the lower portion of the engine compartment 4 is perfectly covered by the engine cover 3 and the casing 2, a shielding property against sea water dashed from the sea surface at the below, is improved.

As the portion right under the flywheel 9 is covered by the flywheel 9 from the above, normally hot air is liable to stagnate at this portion, but in the illustrated embodiment since the flywheel 9 is provided with air communication ports 27 communicating with the fan blades 26, and since an air flow passing the flywheel 9 from the below to the above through these air communication ports is produced, the magnets 31, coils 32, a timing belt 13 and the like disposed under the flywheel 9 are cooled by this air flow, and so, deterioration of durability caused by heat can be precluded.

With respect to the detailed structure shown in FIG. 1, various modifications can be made. FIGS. 5 to 9 illustrate one example of the modifications. In these figures, the portions not different from those shown in FIG. 1 are omitted from illustration, and the portions similar to those shown in FIG. 1 are given like reference numerals.

Figure 5:
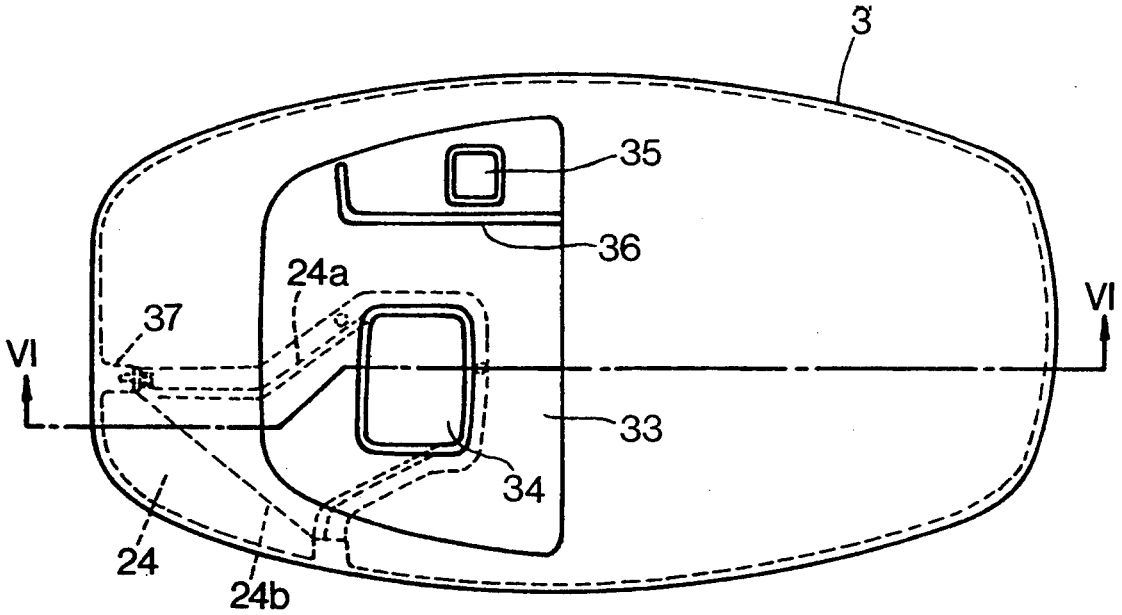
FIG. 5 to 9 show a modification of the above-mentioned first preferred embodiment of the present invention.
Figure 6:
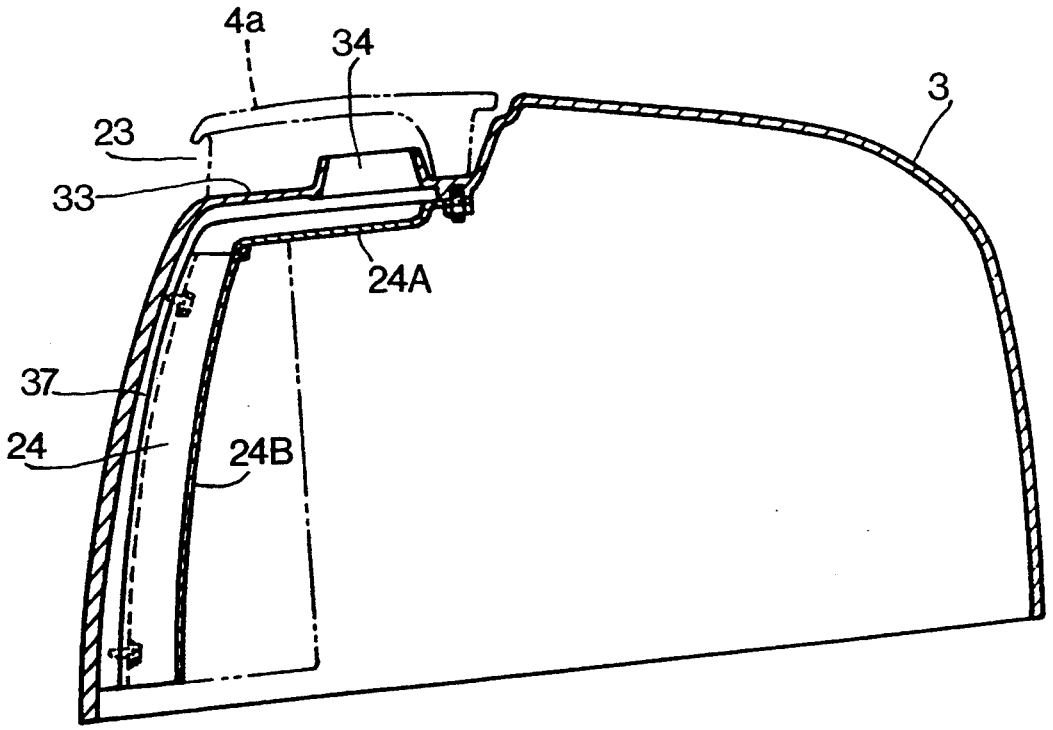

FIG. 5 is a top view showing an engine cover 3 with the above-described cover portion 4*a* removed, and FIG. 6 is a vertical cross-section view of the same. A rear portion of the upper surface of the engine cover 3 is formed into a flat section 33 that is lower than a front portion of the same, and a cover portion 4*a* is adapted to cover the above of the flat section 33. However, in this modified embodiment, a suction port 34 is opened close to the center of this flat section 33, a ventilating exhaust port 35 is opened at a side portion, and these ports are disposed and aligned laterally. A partition wall 36 is erected between the suction port 34 and the ventilating exhaust port 35. Accordingly, the space formed between the flat section 33 and the cover portion 4*a* is partitioned into a space portion communicating with the suction port 34 and a space portion communicating with the ventilating exhaust port 35, and so, the warmed ventilating air which is exhausted from the exhaust port 35 after having cooled the engine within the engine compartment 4 is never mixed with fresh air sucked to the suction port 34 through the air intake port 23.

On the inner wall surface of the flat section 33 is mounted a duct member 24A so as to surround the above-mentioned suction port 34. This duct member 24A forms a duct 24 jointly with the above-mentioned inner wall surface, and it extends nearly horizontally towards a right side corner portion at the rear end of the engine cover 3 while making a detour avoiding a route above the engine. At the above-mentioned corner portion, the duct member 24A is connected to a top end of a duct member 24B. The duct member 24B extends along the above-mentioned corner portion up to a nearly bottom edge position of the engine cover 3, and jointly with the inner wall of the engine cover 3 forms a duct portion directed in the vertical direction. The duct members 24A and 24B are mounted to an inner wall surface of the engine cover 3 via a somewhat wide rib 37 provided on that inner wall surface. The duct member 24B strides the corner portion of the engine cover in a straight line, thereby the cross-section area of the duct at this portion is enlarged to form an expansion chamber, and so, a silencing effect for the sucked air is enhanced.

Figure 7:
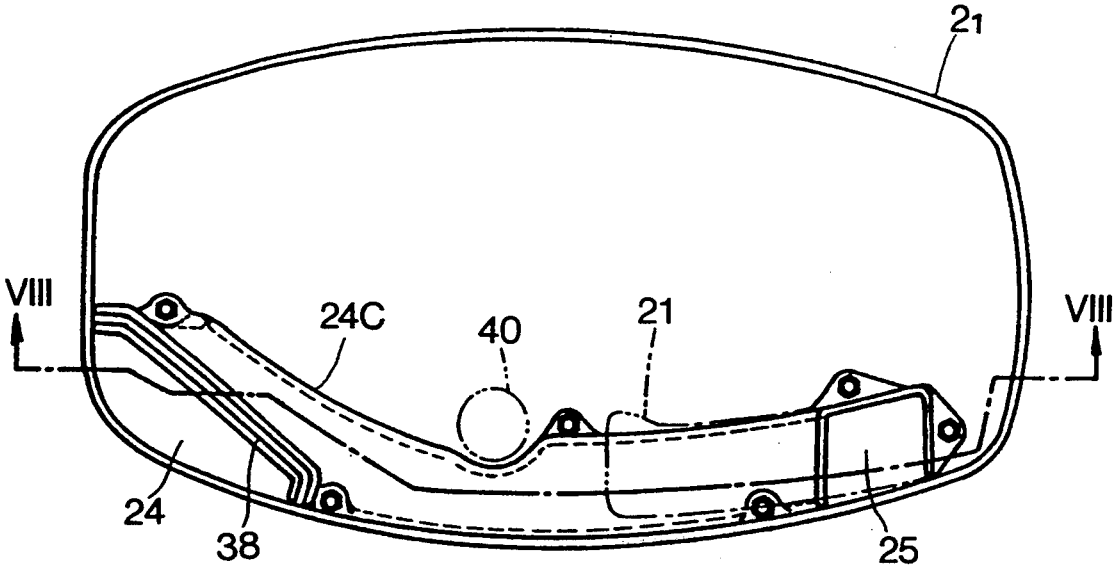
Figure 8:
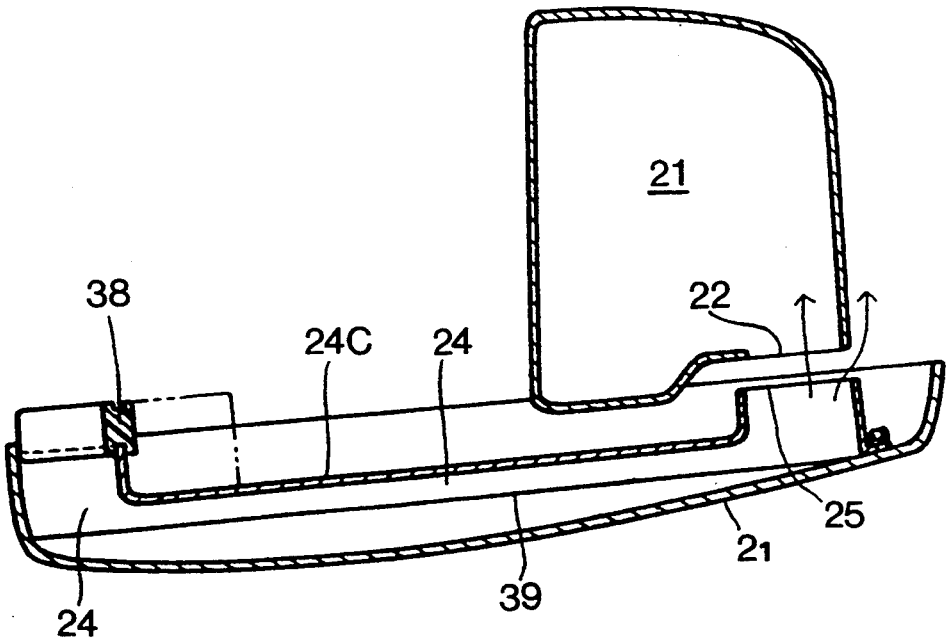

As shown in FIGS. 7 and 8, a duct member 24C is air-tightly connected to the bottom end of the duct member 24B via a rubber piece 38. The duct member 24C extends forwards along the bottom surface of the under case $2_1$, and also along the contour of the under case $2_1$, while avoiding interference with engine accessories such as a fuel filter 40 and the like, and it forms a part of the duct 24 jointly with the bottom surface of the under case $2_1$. This duct member 24C is also fixed to the bottom surface of the under case $2_1$, via a rib 39 provided at the same bottom surface. The front end, that is, the downstream end of the duct member 24C becomes an outlet opening 25 which opens upwards. A part of the air led to the outlet opening 25 through the duct 24 enters the suction chamber 21 through the suction opening 22 and becomes engine intake air, but the other part of the air flows into the engine compartment and serves as cooling and ventilating air. In some cases, the suction opening 22 and the outlet opening 25 could be somewhat staggered. Since the duct member 24B is fixedly secured to the engine cover 3, the duct member 24C is fixedly secured to the under case 21, and the respective members are connected via the rubber piece 38, mounting and dismounting of the engine cover 3 are free. In the event that any surplus space is present within the engine compartment, the duct member 24C also could be mounted to the side of the engine cover 3.

Figure 9:
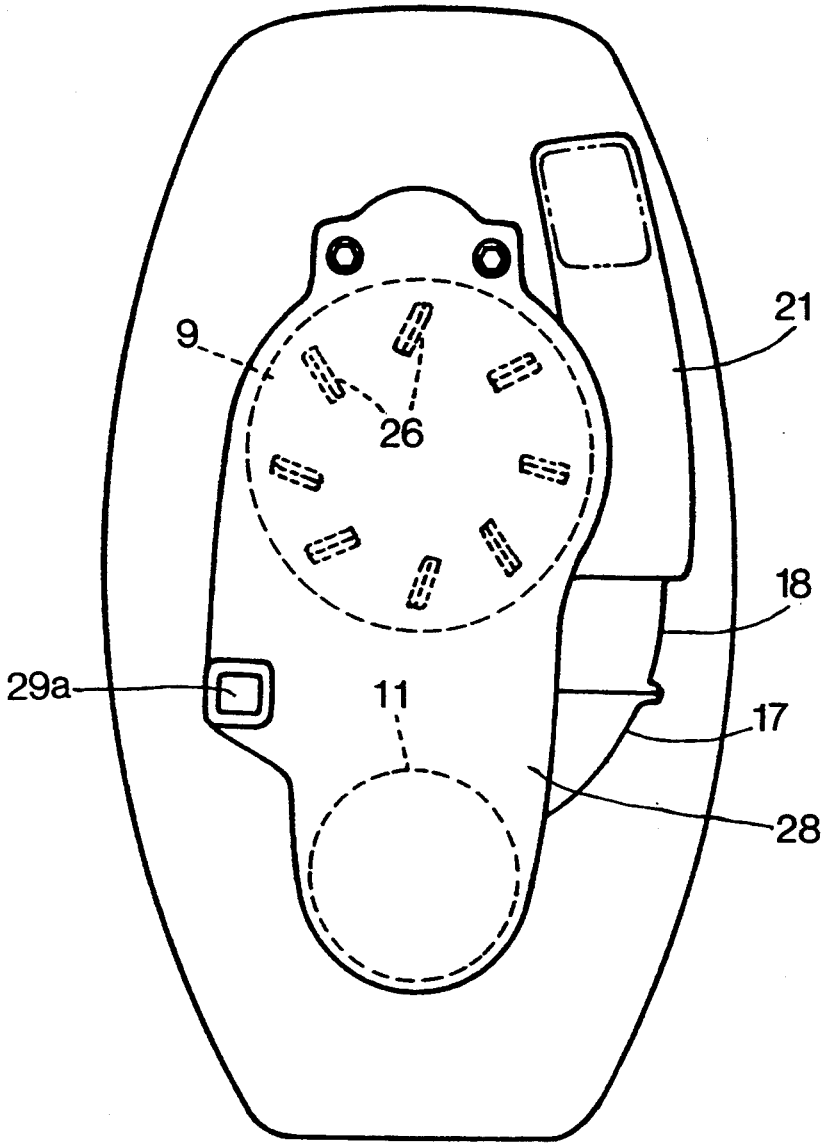

FIG. 9 is a top view showing a relative arrangement of a flywheel cover 28 and a suction chamber 21 within the engine compartment.

Figure 10:
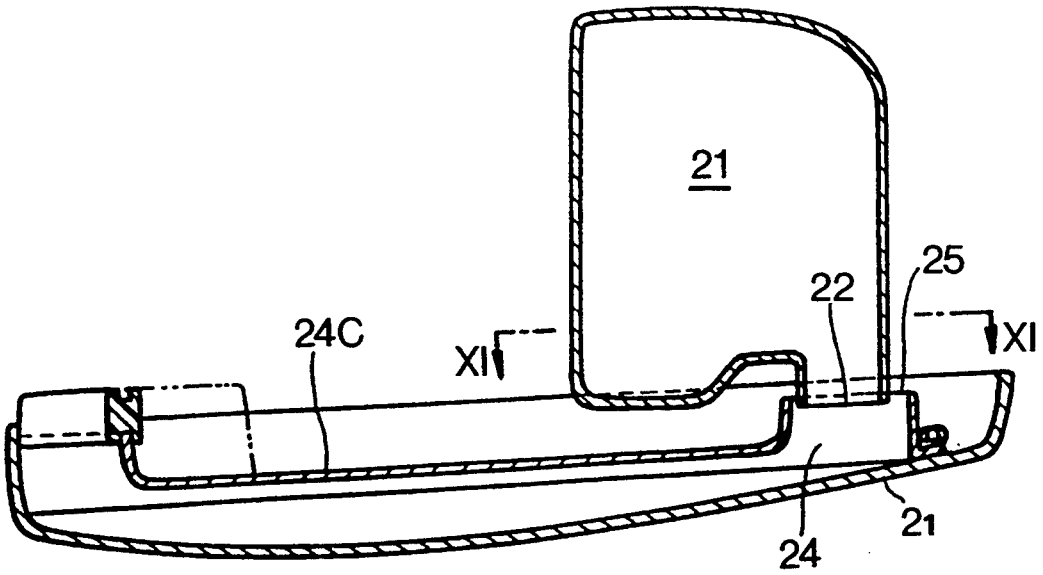
FIG. 10 is a cross-section view similar to FIG. 8 but showing still another preferred embodiment of the present invention.
Figure 11:
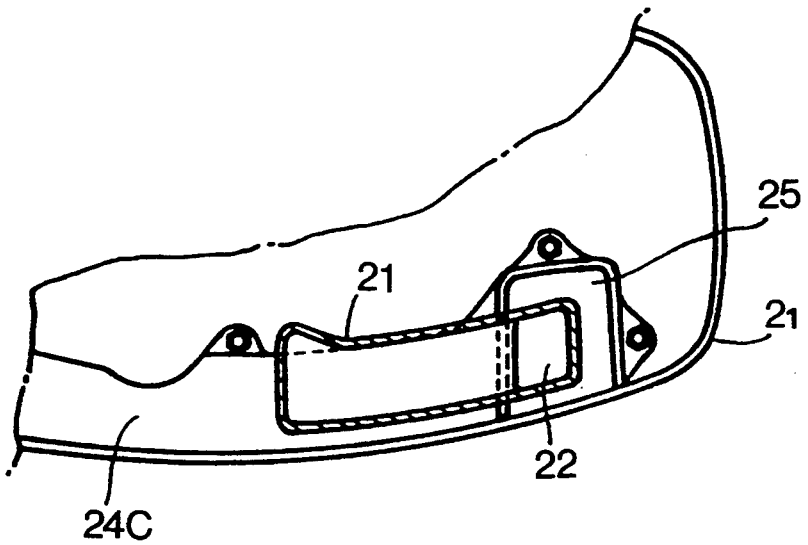
FIG. 11 is a cross-section view taken along line XI—XI in FIG. 10.

FIGS. 10 and 11 illustrate another modified embodiment. In this modification, a suction opening 22 of a suction chamber 21 projects into a duct 24 beyond an opening edge of the outlet opening 25 of the duct 24. The outlet opening 25 is larger than the suction opening 22, and a part of the outlet opening 25 is opened towards the inside of the engine compartment outside of the suction chamber 21.

Figure 12:
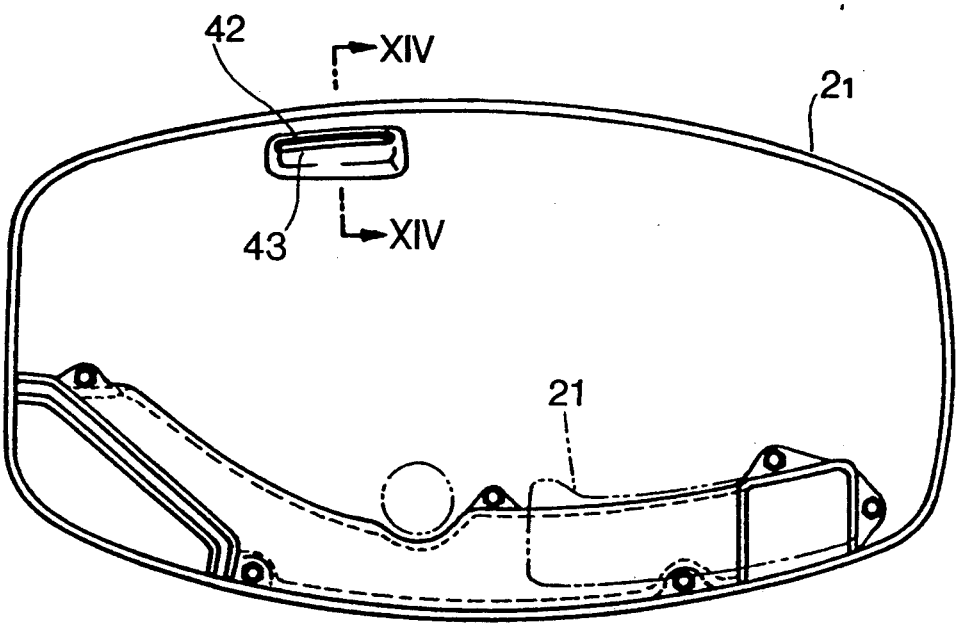
FIG. 12 is a top view similar to FIG. 7 but showing a still further preferred embodiment of the present invention.
Figure 14:
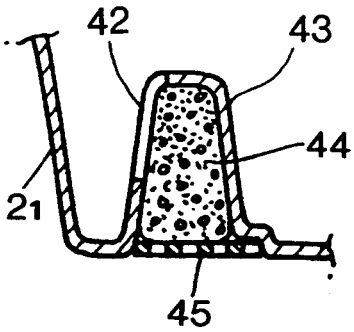
FIG. 14 is a partial cross-section view taken along line XIV—XIV in FIG. 12.
Figure 13:
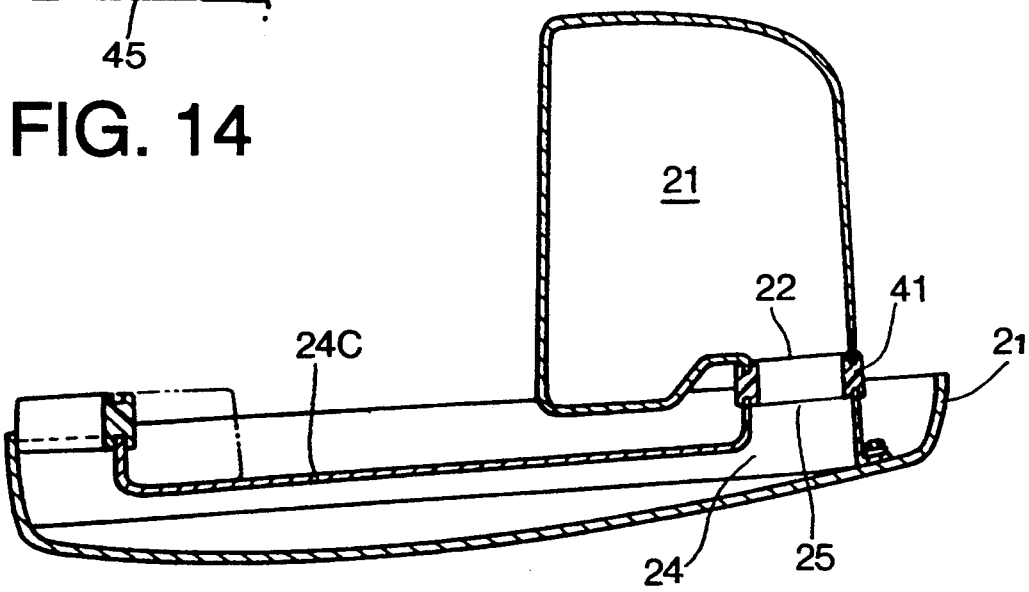
FIG. 13 is a cross-section view similar to FIG. 8 but showing the same still further preferred embodiment of the present invention.

FIGS. 12 to 14 illustrate still another modified embodiment of the present invention. In this preferred embodiment, an outlet opening 25 of a duct 24 and a suction opening 22 of a suction chamber 21 are directly connected with each other via a rubber piece 41, and air introduced to the duct 24 is adapted to entirely enter the suction chamber 21. Also, on the bottom surface of the under case $2_1$ is provided a ventilating introduction port 42, and ventilating air is introduced into the engine compartment 4 through this ventilating introduction port 42. The opening area, number, position and the like of the ventilating introduction ports 42 can be appropriately chosen according to necessity. This ventilating introduction port 42 is provided on a projected portion 43 formed on the bottom surface of the under case $2_1$, a water-barrier member 44 consisting of gas-permeable foamed material is filled in a recess formed on the lower surface side of the above-mentioned projected portion 43, and is held , from the below by means of a holding plate 45. Other water-barrier members consisting of, for instance, meshes or labyrinthes may be used in place of the above-mentioned water-barrier member 44.

As will be apparent from the detailed description of the preferred embodiments of the present invention above, according to the present invention as specified in appended clams 1 to 6, a charging efficiency of an engine is improved due to the fact that low-temperature air introduced through an air intake port is sucked into a suction chamber and serves as an engine intake air while the air is prevented from being heated by an engine and/or being mixed with air heated by an engine to the maximum extent. In addition, a shielding property of the entire surrounding of an engine is also improved.

According to the present invention, an engine within an engine compartment can be cooled effectively, and also, especially since hot air stagnating in the portion right under a flywheel can be exhausted to the above through air communication ports provided in that flywheel by means of a fan, deterioration of durability of component parts disposed in the portion right under the flywheel caused by heat, can be effectively prevented.

While a principle of the present invention has been described above in connection to a number of preferred embodiments of the invention, it is a matter of course that many apparently widely different embodiments of the present invention can be made without departing from the spirit of the present invention.

What is claimed is:

1. An outboard motor, including an engine compartment formed in a top portion of said motor and covered by an engine cover, and an engine disposed within said engine compartment with its crankshaft directed in the vertical direction, said outboard motor comprising:

a suction chamber communicating with an intake section of said engine and disposed on a surface other than a top surface of said engine and on a lower front portion of said engine within said engine compartment;

an air intake port provided in said engine cover at an upper rear portion of said engine within said engine compartment;

an air exhaust port provided in said engine cover; and an air duct provided within said engine compartment for providing a continuous, unbroken air passageway from said air intake port to said suction chamber along a path passing around a lower portion of said engine toward a front portion of said engine.

2. An outboard motor as claimed in claim 1, wherein said engine is disposed with its cylinder axes directed in the horizontal direction and with a crank chamber positioned at a forward portion in said engine compartment, said suction chamber is disposed at a forward position in said engine compartment, and said air intake port is provided at a rearward position with respect to said suction chamber.

3. An outboard motor as claimed in claim 1 or 2, wherein said suction chamber is provided with a suction opening communicating with said engine compartment at a lower portion of said engine compartment, and an outlet opening of said air duct opening opposite said suction opening at a position in said engine compartment lower than said suction opening.

4. An outboard motor as claimed in claim 1 or 2, wherein said air duct opens into a suction opening provided in said suction chamber, and a part of said air duct extends horizontally along the lower portion of the engine and communicates with both the suction opening and an upper portion of the engine compartment.

5. An outboard motor as claimed in claim 1 or 2, wherein said engine compartment is provided with a ventilation air introducing port for introducing external air separately from said air intake port, and a suction opening of said suction chamber and an outlet opening of said air duct are connected with each other.

6. An outboard motor, including an engine compartment formed in a top portion of said motor and covered by an engine cover, an engine disposed within said engine compartment with its crankshaft directed in the vertical direction, and a flywheel mounted to an end portion of said crankshaft projecting upwards from an engine main body, said outboard motor comprising:

an air duct provided within said engine compartment and communicating with an air intake port provided in said engine cover, said air duct provided along a path passing around a lower portion of said engine to form a continuous, unbroken air passageway from said air intake port to a front portion of said engine;

an air exhaust port provided at a top portion of said engine cover;

fan blades provided on the upper surface of said flywheel for directing air within said engine compartment to said air exhaust port; and an air communication port provided in said flywheel for communicating air from said air duct below said flywheel towards said fan blades.

* * * * *